United States Patent [19]

Calvert

[11] 4,340,380

[45] Jul. 20, 1982

[54] ARTICLE CARRIER ERECTING MECHANISM

[75] Inventor: Rodney K. Calvert, Dunwoody, Ga.

[73] Assignee: The Mead Corporation, Dayton, Ohio

[21] Appl. No.: 161,796

[22] Filed: Jun. 23, 1980

[51] Int. Cl.[3] ..... B31B 1/80

[52] U.S. Cl. ..... 493/316; 53/566; 493/312

[58] Field of Search ..... 493/309, 310, 313–318; 53/202, 452, 457, 458, 564, 566

[56] References Cited

U.S. PATENT DOCUMENTS

| | | | |
|---|---|---|---|
| 2,803,932 | 8/1957 | Nigrelli et al. | 53/566 X |
| 4,029,001 | 6/1977 | Reichert | 493/317 X |
| 4,130,050 | 12/1978 | Graf | 493/169 |

FOREIGN PATENT DOCUMENTS

| | | | |
|---|---|---|---|
| 587649 | 1/1959 | Italy | 53/564 |

*Primary Examiner*—James F. Coan

*Assistant Examiner*—Charles L. Willis

*Attorney, Agent, or Firm*—Erwin Doerr

[57] ABSTRACT

An erector mechanism for setting-up article carriers of the basket type from a collapsed condition to a set-up condition comprises a pivotal arm arranged to oscillate between a pair of spaced carrier erector locations. The erector locations each include a pivotal leg having suction elements to withdraw collapsed carriers from a supply and maintain them in position for setting-up and the pivotal arm includes two opposed sets of suction elements for cooperation with the suction elements of the respective pivotal legs in that position so that the carrier side walls are drawn apart to set up the carrier. The pivotal legs are timed from a cam system to withdraw carriers from a supply at each erector section alternately and the pivotal arm is synchronized by the cam system to cooperate in the carrier setting-up procedure with each pivotal leg in turn while the other pivotal leg is actuated to withdraw the next succeeding carrier.

10 Claims, 3 Drawing Figures

ARTICLE CARRIER ERECTING MECHANISM

TECHNICAL FIELD

This invention relates to a mechanism for erecting basket style article carriers of the type shown in U.S. Pat. No. 4,187,944 from a collapsed to a set-up condition in a continuous operation. Such carriers include partition elements extending inwardly from each end wall and are characterized in that the end walls are separated from the end edges of the bottom wall. To maintain such carriers in set-up condition after they have been expanded, means for interlocking the end walls with the bottom wall are provided at the lower ends of the medial partition elements.

The mechanism is particularly suitable for use where a continuous supply of set-up article carriers is required, for example, in the packaging of bottled beverages. The mechanism may be used alone or in conjunction with a packaging machine such as the bottle loading machine described and claimed in U.S. Patent Application Ser. No. 161,799 filed by the assignee of the present application on even date therewith.

BACKGROUND ART

Machines for erecting bottle carrier cartons are known in the prior art and are shown for instance in U.S. Pat. No. 2,780,970 to Gentry, U.S. Pat. No. 3,027,815 to Anness et al., and U.S. Pat. No. 3,343,466 to Sherman. Such machines have been used for years and are well suited for relatively low-speed operations. However, the capacity of such machines is not adequate for the present high-speed filling lines, particularly when the carton erecting mechanism is to be integrated with machines for loading bottles into the erected cartons.

DISCLOSURE OF THE INVENTION

The invention provides a mechanism for erecting article carriers of the basket style from a collapsed to a set-up condition, which mechanism comprises an arm mounted for pivotal movement between two carrier erecting locations, means at each of said erecting locations for holding a carrier during the carrier erecting procedure and wherein said arm includes attachment means for cooperation with each of said holding means to effect the erecting procedure, drive means being provided to oscillate said arm from one of said carrier erecting locations to the other of said carrier erecting locations so that carriers are set up at each of said erecting locations alternately by cooperation between respective ones of said holding and said attachment means.

BRIEF DESCRIPTION OF DRAWINGS

A specific embodiment of the invention, by way of example, is now set forth in the following description taken in conjunction with the accompanying drawings, in which.

BEST MODE OF CARRYING OUT THE INVENTION

Figure 1:
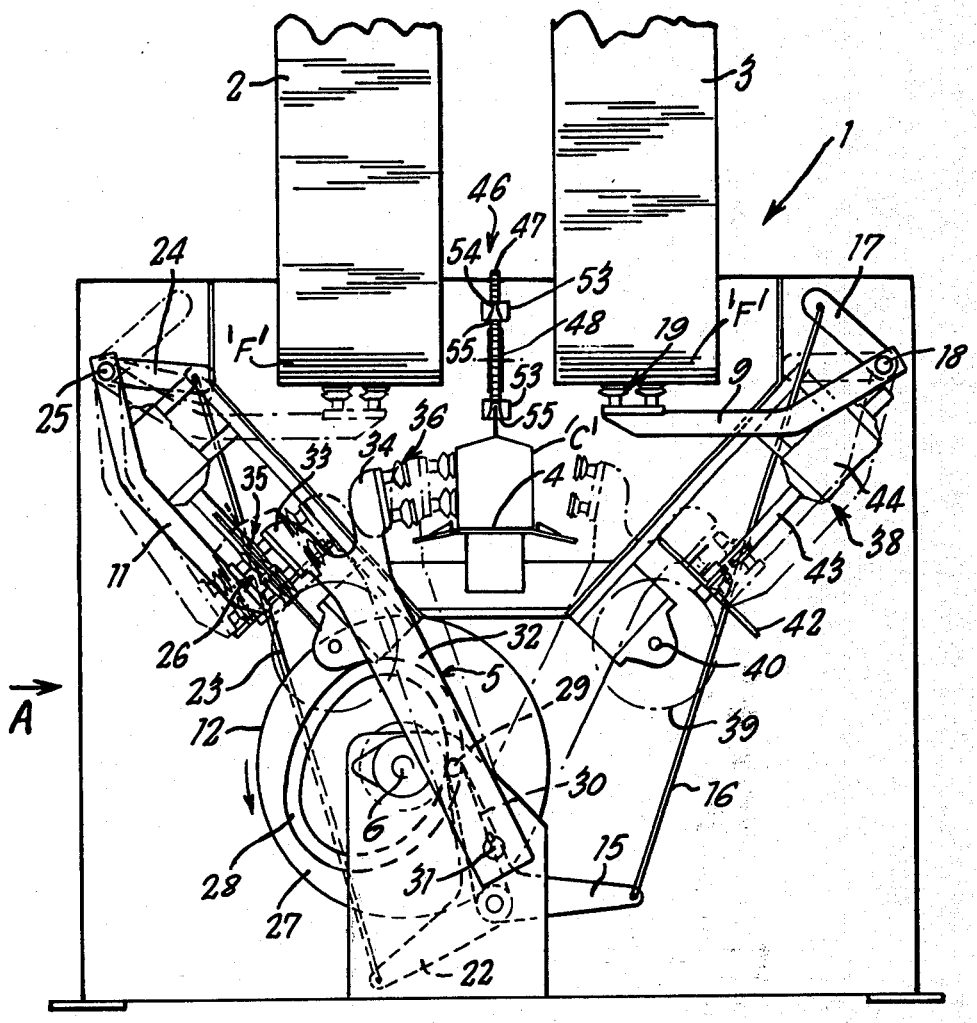
FIG. 1 is an end view of the carrier erecting mechanism.

In general, the bottle carrier erector mechanism 1 comprises a pair of supply hoppers 2, 3 located in spaced side by side relationship above and straddling a carrier receiving platform 4. Each hopper accommodates a supply of flat collapsed bottle carriers 'F'. The carrier receiving platform 4 is located centrally in the carrier erector mechanism 1 and has erected carriers 'C' deposited thereon for transportation out of the mechanism housing.

The erected carriers 'C' are deposited on platform 4 by means of an oscillatory bifurcated arm 5 which is driven from a camshaft 6 through a cam arrangement.

More specifically, the carrier erector mechanism 1 includes camshaft 6 powered by suitable means and carrying a series of cam plate assemblies 7 for operating the carrier erecting components which include the oscillatory bifurcated arm 5. The cam assemblies 7 comprise in series, a cam system 8 for imparting oscillatory movement to a suction-cup arm 9 which withdraws collapsed carriers 'F' sequentially from one (right hand) hopper 3, a cam system 10, for imparting oscillatory movement to a suction-cup arm 11 which withdraws collapsed carriers 'F' sequentially from the other (left hand) hopper 2, and a further cam system 12 for imparting oscillatory movement to the bifurcated arm 5 for cooperation with suction-cup arms 9 and 11.

The cam system 8 consists of a circular cam plate 13 having a continuous cam track (not shown) comprising a groove machined into one of its faces in which a follower roller 14 runs. The follower roller 14 is carried by a cam arm 15 which is attached to one end of a connecting rod 16. The connecting rod 16 extends upwardly within the erector mechanism housing and has its other end attached to a drive link 17 for imparting rotary motion to a short drive shaft 18 which carries the suction-cup arm 9. The free end of arm 9 is provided with a group of suction cups 19 which are vacuum operated by suitable pneumatic valves '$V_1$' located adjacent the free end of the camshaft 6. Similarly, the cam system 10 consists of a circular cam plate 20 having a continuous cam track (not shown) comprising a groove machined into one of its faces in which a follower roller 21 runs. The follower roller 21 is carried by a cam arm 22 which is attached to one end of a connecting rod 23. The connecting rod 23 extends upwardly within the erector mechanism housing and has its other end attached to a drive link 24 for imparting rotary motion to a short drive shaft 25 which carries the suction-cup arm 11. The free end of arm 11 is provided with a group of vacuum cups 26 which are vacuum operated by the pneumatic valves '$V_1$' located adjacent the free end of the camshaft 6. The cam system 12 consists of a circular cam plate 27 having a continuous cam track comprising a groove 28 machined into one of its faces in which a follower roller 29 runs. The follower roller 29 is carried at one end of a cam arm 30 the opposite end of which is connected to one end a rotatable shaft 31. The other end of shaft 31 is connected to the lower end of the bifurcated arm 5 which extends upwardly within the erector mechanism housing 1 for oscillatory movement across the end of platform 4. The bifurcated arm 5 comprises a main stem 32 which terminates in a pair of branch arms 33, 34 each of which carries a group of suction cups 35, 36 respectively, adjacent its free end. The suction cups 35, 36 are vacuum operated by suitable pneumatic valves '$V_2$'located adjacent the free end of the camshaft 6.

In operation, power transmitted through the camshaft 6 causes each of the circular cam plates 13, 20 and 27 to rotate together thereby causing the cam follower rollers 14, 21 and 29 to move around their respective cam tracks.

Referring to FIG. 1, the carrier set-up procedure as applied to cam system 8 for initial withdrawal of a carrier from hopper 3 is as follow: The suction-cup group 19 at the end of arm 9 is engaged with one side wall of the lowermost collapsed carrier 'F' in the stack within hopper 3 and a suction force then applied by activating pneumatic valves '$V_1$'. As rotation of the cam system 8 continues the suction-cup arm 9 is caused to move downwardly by transmission of motion through the connecting rod 16 whereby the lowermost collapsed carried is withdrawn from the hopper stack. During this procedure the bifurcated arm 5 is caused to pivot by rotation of cam system 12 such that the branch arm 34 is moved towards the downwardly swinging suction-cup arm 9. When the suction-cup arm 9 reaches its lowermost position (as shown in phantom in FIG. 1), the bifurcated arm 5 has reached the end of its pivotal movement in that direction whereupon the suction-cup group 36 of arm branch 34 engages with the opposite sidewall of the withdrawn carrier and a suction force is then applied via pneumatic valve '$V_2$'. The suction-cup arm 9 now experiences a pause caused by a dwell period in the cam system 8 while at the same time suction force in the suction-cup groups 19 and 36 is maintained and rotation of cam system 12 causes bifurcated arm 5 to pivot in the opposite (return) direction thus causing the branch arm 34 to move away from suction-cup arm 9. The effect of maintaining suction force in suction-cup groups 19 and 36 during return motion of arm 5 is that the carrier sidewalls are moved apart thus causing the carrier to be expanded. The carrier walls are then locked to maintain the set-up condition as explained shortly. Immediately after the setting-up procedure, vacuum force applied by suction-cup group 19 is relieved so that the carrier is released from engagement with suction-cup arm 9. Bifurcated arm 5 continues its return pivotal movement during which time the suction-cup arm 11 withdraws a carrier blank from hopper 2 by action of cam system 10 in a manner similar to that described with reference to the withdrawal procedure from hopper 3. Generally simultaneously with this action, the suction force applied to a sidewall of set-up carrier 'C' by the group of suction cups 35 is relieved when branch arm 34 is adjacent platform 4 whereby carrier 'C' is released and deposited on the platform 4.

At the completion of the return pivotal movement the suction-cup groups 35 of arm branch 33 engages the uppermost sidewall of the collapsed carrier withdrawn from hopper 2 by arm 11 and the other suction-cup arm 9 pivots upwardly towards hopper 3 to begin the next succeeding carrier withdrawal procedure. Suction force is applied through suction-cup group 35 so that the newly withdrawn collapsed carrier 'F' is engaged for the setting-up operation. Thus the carrier withdrawal and setting-up procedure continues with the oscillatory movement of bifurcated arm 5 allowing collapsed carriers to be withdrawn from the pair of hoppers alternately and deposited onto platform 4.

Figure 3:
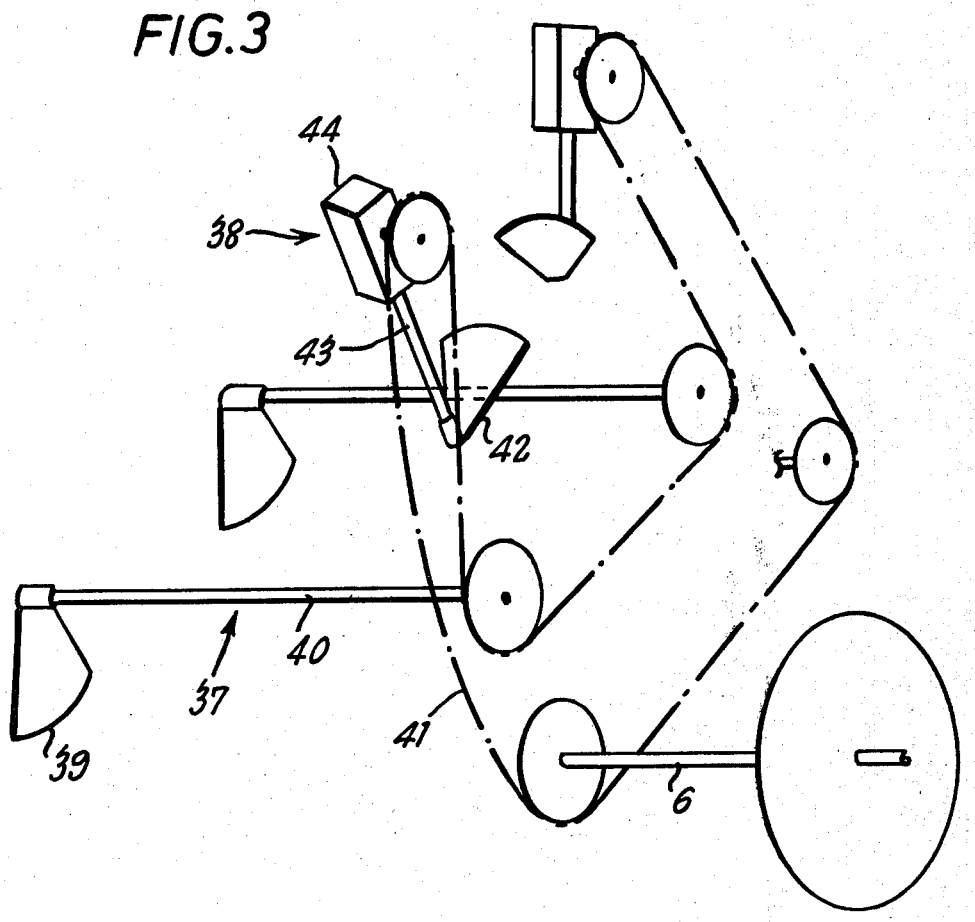
FIG. 3 is a schematic diagram showing the carrier locking devices and their drive connections.

The carrier locking operation previously referred to is achieved by means of two sets of rotatable locking devices timed for operation from the camshaft 6 and driven by an endless chain 41 trained about sprockets associated with each set of locking devices and with camshaft 6 as shown in FIG. 3. One set of such locking elements is located adjacent each side of platform 4 so that set-up carriers are locked immediately prior to being deposited on platform 4. Referring to FIGS. 1 and 3, each set of locking devices comprises a bottom wall pusher plate assembly 37 and an end wall pusher plate assembly 38. The assembly 37 comprises segmental plate 39 carried at one end of a rotatable shaft 40 located adjacent platform 4 with shaft 40 extending parallel to the camshaft 6. The opposite end of shaft 40 is provided with a sprocket by which shaft 40 is driven in an appropriately timed manner via chain 41. The assembly 38 comprises a similar segmental plate 42 carried at one end of a rotatable shaft 43 which extends downwardly adjacent platform 4 with its axis inclined and normal to that of the camshaft 6. The opposite end of shaft 43 is housed in a gearbox 44 through which the shaft is driven via a sprocket associated with the gearbox and chain 41. The relationship of the sprockets is such that the sprocket associated with the camshaft 6 makes one-half revolution while the sprockets associated with shaft 40 and 43 make a full revolution per carton. The two sets of locking devices are arranged to operate in sequence so that immediately upon expanding the carrier the end wall thereof is urged inwardly past the adjacent end edge of the bottom wall by rotation of the segmental plate 42 wiping across the end wall whereafter the bottom wall is urged upwardly by rotation of the segmental plate 39 wiping across the carrier base so that the locking parts of those carrier walls are engaged to maintain the carrier in its set-up condition. The transportation of set-up carriers 'C' from the carrier receiving platform 4 out of the erector mechanism housing is initiated by an overhead conveyor assembly 46 located above the carrier receiving platform 4.

Figure 2:
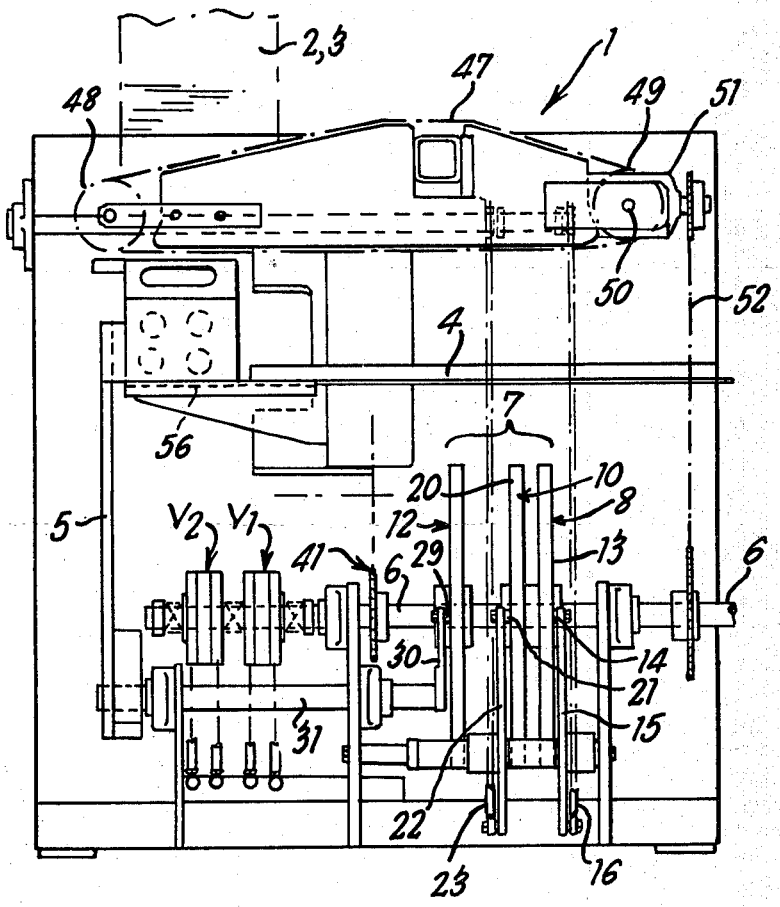
FIG. 2 is a side view of the carrier erecting mechanism taken in the direction of arrow 'A' in FIG. 1.

Referring to FIGS. 1 and 2 the assembly 46 comprises a continuous belt, in this case a chain drive 47, passing around an idler sprocket 48 and a drive sprocket 49 spaced from the idler sprocket 48 and both located with their axes transversely of the machine. The drive sprocket 49 is driven by a drive shaft 50 also extending transversely of the machine and which is powered at an appropriate speed through a gearbox 51 by means of a drive take-off from camshaft 6 provided by a chain and sprocket set 52. In order to engage and move carriers 'C' which are deposited on the platform 4 the chain drive 47 includes a plurality of pusher elements 53 each for engagement with an upstanding handle section of a carrier (See FIG. 1). Each pusher element 53 comprises a block having formed therein a slot 54 with a flared mouth 55 into which the handle section of a carrier is received. The pusher blocks approach and engage the carriers from behind and transport the carriers along the platform 4 out of the carrier erector housing. As shown in FIG. 2, the platform 4 is formed with a reject aperture 56 through which incompletely set-up carriers are discarded.

What I claim is:

1. A mechanism for erecting article carriers of the basket type from a collapsed to a set-up condition, which mechanism comprises an arm mounted for oscillatory movement between two carrier erecting locations, means at each of said erecting locations for holding a carrier during the carrier erecting procedure and wherein said arm includes attachment means for cooperation with each of said holding means to effect the erecting procedure, drive means being provided to continuously oscillate said arm from one of said carrier erecting locations to the other of said carrier erecting locations so that carriers are set up at each of said erecting locations alternately by cooperation between respective ones of said holding and said attachment means, characterized in that said holding means each comprises a pivotal leg having at its free end at least one suction element to extract a collapsed carrier from a supply when the leg is pivoted to a first position, and to hold said collapsed carrier during cooperation with said attachment means when the leg has been pivoted to a second position, each pivotal leg being actuated by said drive means so that one leg is in said first position while the other leg is in said second position.

2. A mechanism according to claim 1 in which said attachment means comprises a plurality of suction elements located adjacent the free end of said arm such that there is a first suction element for cooperation with the holding means at one of said carrier erecting locations and an opposite facing second suction element for cooperation with the holding means at the other of said carrier erecting locations.

3. A mechanism according to claim 2 in which a platform is located intermediate said carrier erecting locations to receive set-up carriers, said platform being located such that the pivotal arm can pass across one end of said platform during oscillatory movement between said carrier erecting locations, and wherein said suction elements on the pivotal arm are actuated in turn to transfer a set-up carrier alternately from each of said carrier erecting stations to said platform.

4. A mechanism according to claim 3 in which a set-up carrier is deposited on the platform by said first suction element of the pivotal arm immediately prior to engagement by said second suction element of the pivotal arm with a collapsed carrier held by said other pivotal leg while that leg is located in said second position, and wherein the next succeeding set-up carrier is deposited on the platform by said second suction element of the pivotal arm immediately prior to engagement by said first suction element of the pivotal arm with a collapsed carrier held by said one pivotal leg while that leg is located in said second position.

5. A mechanism according to claim 5 in which said pivotal arm is bifurcated to provide a pair of branch arms, and wherein one branch arm carries said first suction element and the other branch arm carries said second suction element.

6. A mechanism according to claim 1, in which said drive means includes a cam system for imparting synchronized oscillatory movement to said pivotal arm and to each of said pivotal legs.

7. A mechanism according to claim 6 in which said cam system comprises a series of cam plates located on a camshaft, each cam plate having formed in a surface thereof a cam follower track and there being a cam follower located to run in each of said cam tracks each of said cam followers being carried by a cam arm for transmitting said cam action to said pivotal arm and said pivotal legs.

8. A mechanism according to claim 3 or claim 4 further comprising a feed mechanism to move set-up carriers from said platform, said feed mechanism comprising an endless belt arranged to rotate in timed relationship with respect to the carrier set-up procedure, which belt is located above said platform and includes a series of spaced pusher elements each for engagement with a carrier present on the platform so as to move the carrier along during rotation of the belt.

9. A method for erecting article carriers of the basket type from a collapsed condition to a set-up condition, which method comprises causing a collapsed article carrier to be removed from a supply for presentation for a set-up procedure alternately at each of two-carrier erecting locations, actuating an oscillatory arm for cooperation with the collapsed carrier at each erecting location in turn for effecting setting up of that carrier and synchronizing presentation of said carriers and oscillatory movement of said arm such that a carrier is removed from said supply at one carrier erecting location while said arm is effecting carrier set-up at said other carrier erecting location, and vice versa.

10. A mechanism for erecting article carriers of the basket type from a collapsed to a set-up condition, which mechanism comprises an arm mounted for oscillatory movement between two carrier erecting locations, a platform located intermediate said carrier erecting locations to receive set-up carriers, means at each of said erecting locations for holding a carrier during the carrier erecting procedure, said arm including suction elements for cooperation with said holding means to effect the erecting procedure and drive means for continuously oscillating said arm from one of said carrier erecting locations to the other of said carrier erecting locations so that carriers are set-up at each of said erecting locations alternately by cooperation between respective ones of said holding means and suction elements, said platform being located such that the oscillatory arm can pass across one end of said platform during oscillatory movement between said carrier erecting locations, said suction elements on the oscillatory arm being actuated so as to transfer a set-up carrier alternately from each of said carrier erecting locations to said platform.

* * * * *